United States Patent [19]

Hasan et al.

[11] Patent Number: 4,998,662

[45] Date of Patent: Mar. 12, 1991

[54] FASTENER-DRIVING AND BATTEN-POSITIONING MACHINE

[75] Inventors: Syed R. Hasan, Palatine; John R. Beach, Elmhurst, both of Ill.

[73] Assignee: Illinois Tool Works, Inc., Glenview, Ill.

[21] Appl. No.: 331,149

[22] Filed: Mar. 31, 1989

[51] Int. Cl.[5] ..... B27F 7/02

[52] U.S. Cl. ..... 227/111; 227/012; 227/120

[58] Field of Search ..... 227/111, 12, 13, 44–46, 227/120, 29, 28

[56] References Cited

U.S. PATENT DOCUMENTS

| | | | |
|---|---|---|---|
| 3,283,986 | 11/1966 | McKee | 227/120 |
| 3,310,215 | 3/1967 | Bostick | 227/111 |
| 3,476,302 | 11/1969 | Hurd | 227/120 |
| 3,589,585 | 6/1971 | Cerioni | 227/120 X |
| 3,727,821 | 4/1973 | Pabich et al. | 227/120 |
| 3,771,708 | 11/1973 | DeNicola et al. | 227/111 |
| 3,796,365 | 3/1974 | Downing | 227/111 X |

*Primary Examiner*—Paul A. Bell

*Assistant Examiner*—Rinaldi Rada

*Attorney, Agent, or Firm*—Schwartz & Weinrieb

[57] ABSTRACT

A fastener-driving and batten-positioning machine useful in roofing applications includes a shoe, which has an underside and a pair of spaced guides depending from the underside, and which is arranged to position a batten over a sheet of roofing material, beneath the underside and between the guides, while the batten is being fastened. A stand-up screw gun, which is incorporated into the machine, is used to drive a fastener, such as, for example, a screw, through a batten, through the sheet and through any underlying sheets of roofing materials, into an underlayment. The screw gun is mounted upon the shoe, which is mounted upon a base in such a manner as to provide for relative movement between the shoe and the base. The shoe is biased gravitationally, and by means of a spring, so as to urge the shoe toward the batten while the batten is being fastened. A canister, which is mounted upon the base, is arranged to receive the batten in the form of a coil, which tends to expand when released, and to supply the batten to the shoe, through means of an outlet of the canister.

18 Claims, 3 Drawing Sheets

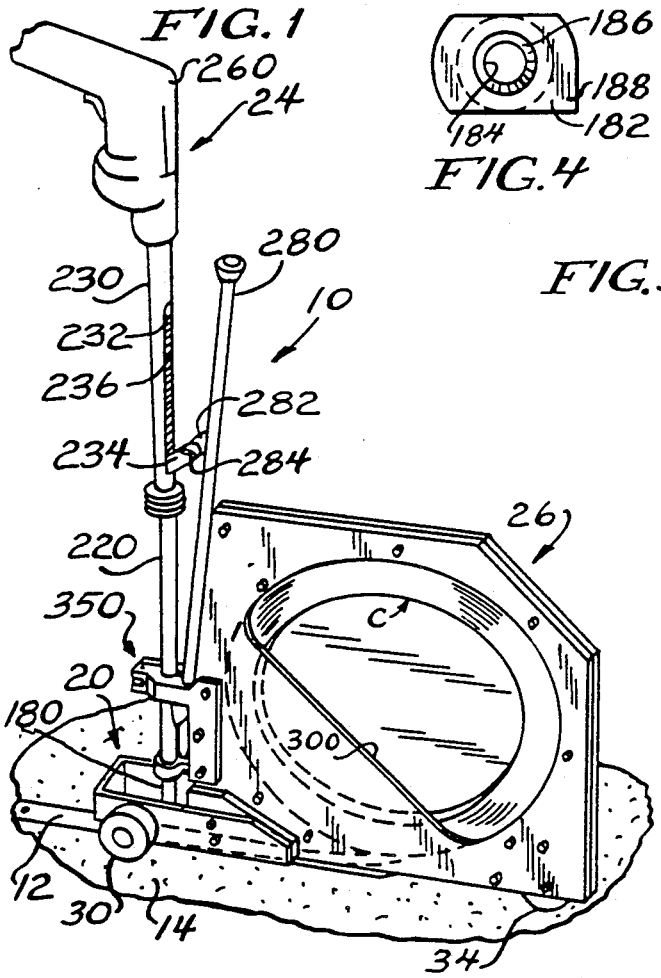
FIG. 4
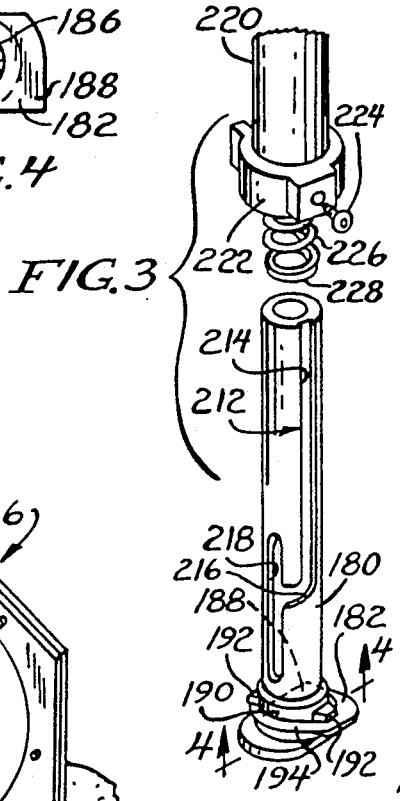
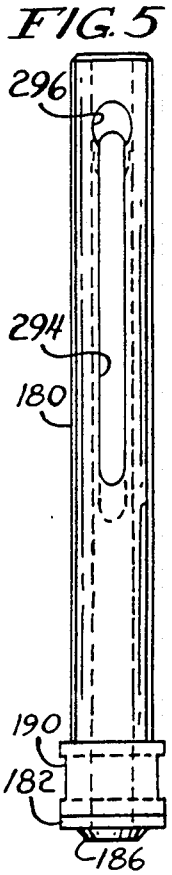
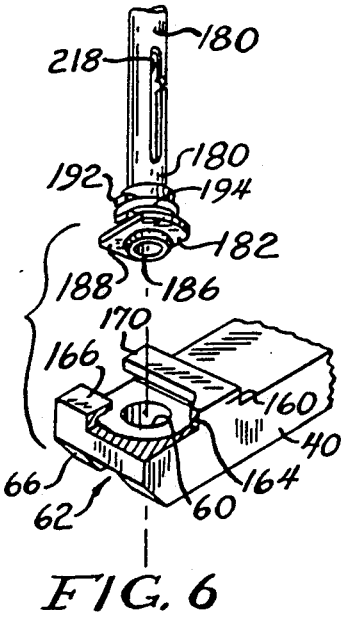
FIG. 6
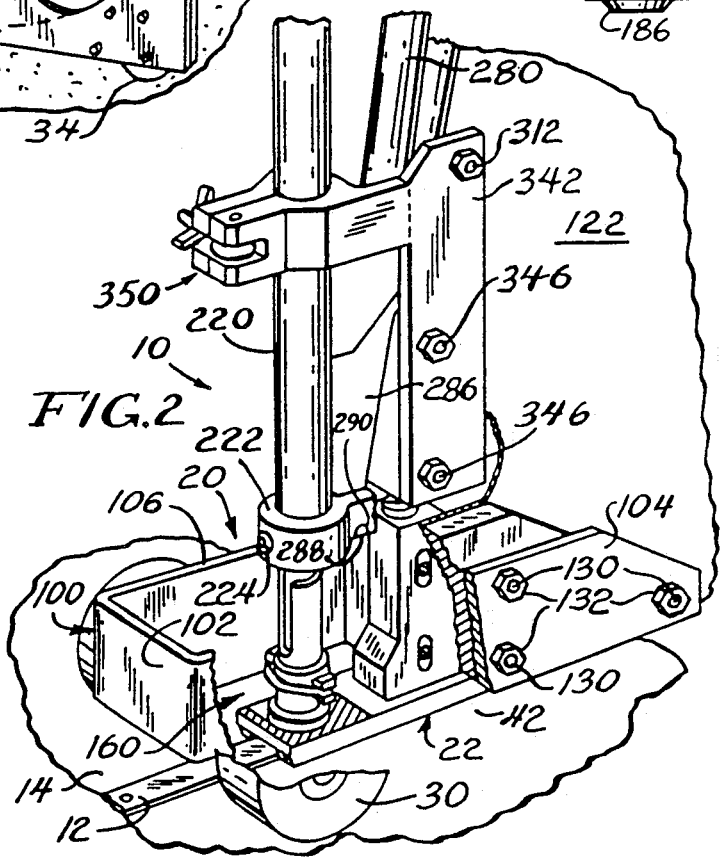

10
280
302
304
320
312
322
122
126
298
286
340
346
350
296
18'
294
344
20
288
180
192
190
42
32
8
194
30
44
40
22
38
12
13
9
146
130
44
330
108
124
326
338
328
336
334
332
82
80
64
306
308
324
34
36

220
292
296
180
294

102
110
100
106
32
104
108

220
262
358
360
364
362
342
180
368
280
366
350
356
352
340

FIG. 11
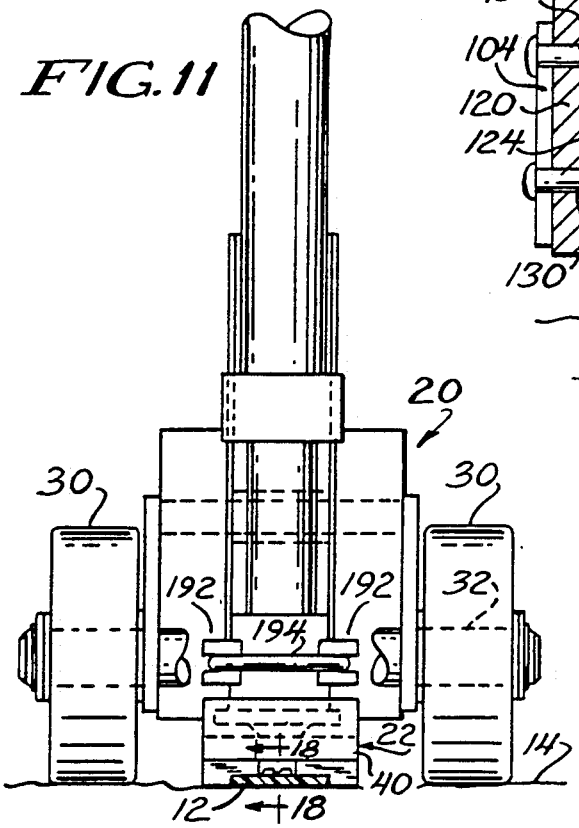
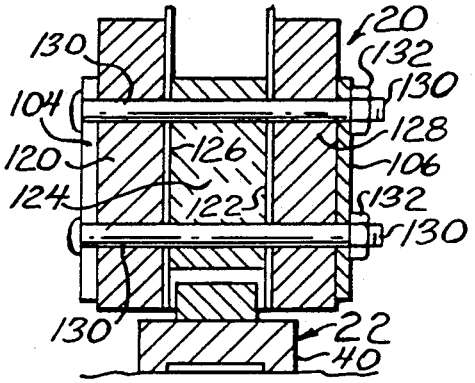
FIG. 13
FIG. 12
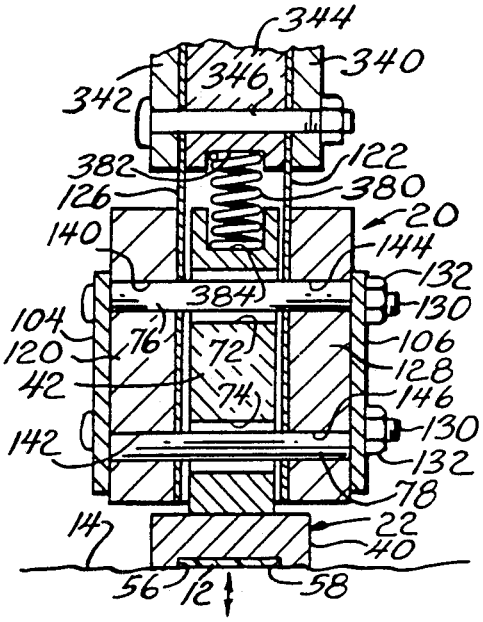
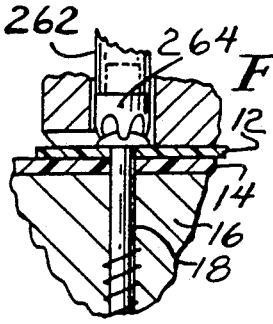
FIG. 18
FIG. 14
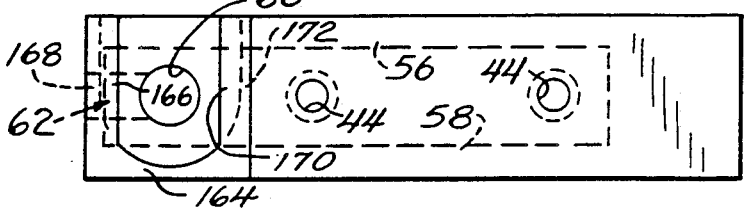
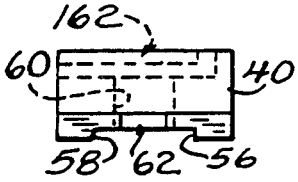
FIG 15
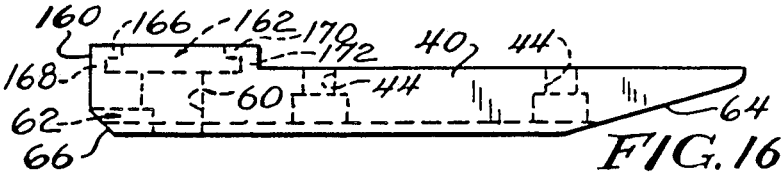
FIG. 16
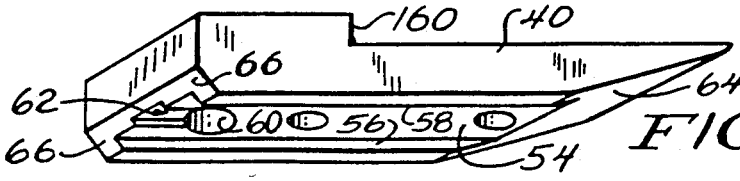
FIG. 17

FASTENER-DRIVING AND BATTEN-POSITIONING MACHINE

TECHNICAL FIELD OF THE INVENTION

This invention pertains to a fastener-driving and batten-positioning machine useful to position a batten before and during the time that the machine is used to materials to an underlayment.

BACKGROUND OF THE INVENTION

It is known to use battens when fastening a single sheet of roofing material, such as, for example, a roofing membrane or a blanket of roofing insulation, or plural sheets of roofing materials, such as, for example, overlapped edges of two roofing membranes covering a blanket of roofing insulation, to an underlayment, such as, for example, a wooden roof or a corrugated metal roof, by means of a series of screws or other fasteners. A batten is a thin, narrow strip of a relatively stiff material, which for a roofing application should be split-resistant and weather-resistant. When fastened along one edge of a roofing membrane, a batten helps to form a seal beneath the edge and to prevent the edge from lifting, as when the edge is exposed to a strong wind.

Although wooden battens or metal battens have been used historically, polymeric battens have become available, which may replace such wooden or metal battens for many roofing applications. Typically, metal battens are provided with pre-punched or pre-drilled holes at regular intervals, such as, for example, 6-inch or 12-inch intervals, so as to accommodate fasteners, such as, for example, screws, and the battens are also formed so as to have predetermined lengths, such as, for example, 10-foot lengths. Wooden battens may be analogously provided with pre-drilled holes at regular intervals. It is known to provide an elongate batten, either metal or polymeric, in the form of a coil having a large nominal diameter, such as, for example, an 18-inch nominal diameter. Battens tend to be too stiff to be readily coiled into coils that are much smaller. Typically, battens are fastened by screws, although it also is known to use nails or staples to fasten battens.

Conventionally, whether he or she is laying such battens in short lengths or in coils, a worker frequently stoops over so as to manually position such battens, before and during fastening the battens and one or more sheets of roofing materials to an underlayment. Obviously, it is cumbersome, tiresome work for a worker to position such battens manually.

A machine for laying a thin, relatively limp tape, such as, for example, rayon cord tape, and for stapling the tape onto a sheet of roofing material is disclosed in De Nicola et al, U.S. Pat. No. 3,771,708. The machine, as disclosed therein, is not useful with battens, however, since battens, even if coilable, are relatively stiff compared to such tapes.

Hence, there has been a need, to which this invention is addressed, for a machine useful to position a batten, particularly but not exclusively a batten provided in the form of a coil, before and during the time in which the machine is used to fasten the batten and one or more sheets of roofing materials to an underlayment.

Herein, such terms as "roof" and "roofing" are to be broadly understood, so as to encompass roofs, decks, ceilings, and similar structures.

SUMMARY OF THE INVENTION

This invention is concerned with a fastener-driving and batten-positioning machine. The machine is useful to position an elongate batten having two parallel, expansive surfaces over a sheet of roofing material, such as, for example, a roofing machine or a blanket of roofing insulation, and to fasten the positioned batten, the sheet of roofing material, and any underlying sheets of roofing materials to an underlayment, such as, for example, a wooden roof or a corrugated metal roof, by means of a series of fasteners, such as, for example, screws.

Although a polymeric batten is preferred, a metal batten can be alternatively used in the machine as broadly contemplated. In addition, a wooden batten can be alternatively used in the machine as broadly contemplated. It is preferred that the batten not have preformed holes, but for the machine to drive fasteners, such as, for example, self-drilling screws, through the batten.

Although the machine is particularly useful for fastening a batten over a roofing membrane, and more particularly along one edge of a roofing membrane, the machine can be similarly used to fasten a batten over a sheet of roofing material of a different type, such as, for example, a blanket or roofing insulation. The machine is useful to fasten a batten and plural sheets of roofing materials, such as, for example, overlapped edges of two roofing membranes covering a blanket of roofing insulation, to an underlayment, as well as to fasten a batten and a single sheet of roofing material to an underlayment. Although screws are preferred, such as, for example, selftapping screws, nails or staples can be alternatively used in the machine as broadly contemplated.

Specifically, the machine comprises a base, a shoe, and fastener-driving means, as discussed below. Moreover, the machine may comprise a canister, as discussed below.

The shoe has an underside, preferably a planar underside, and spaced guides depending from the underside, preferably two such guides in parallel relation with respect to each other. The shoe, which is mounted to the base so as to permit relative movement between the shoe and the base, is biased so as to be moved toward the batten while the batten is being fastened by means of the machine. The shoe is arranged so as to position such a batten, with one of its expansive surfaces overlying a sheet of roofing material, beneath the underside of the shoe and between the guides of the shoe, while the batten is being fastened by means of the machine.

The fastener-driving means, which is mounted to the shoe so as to permit relative movement between such means and the base, is actuatable for driving a fastener through such a batten being positioned by means of the shoe, through a sheet of roofing material disposed beneath the batten, and through any underlying sheets of roofing materials, into an underlayment, at a given location along the batten. Then, after such a fastener has been driven at a given location along such a batten, the machine can be moved to another location, which is spaced from the given location, at which another such fastener can be similarly driven.

The fastener-driving means may be advantageously provided by components of a screw gun, preferably a stand-up screw gun, which causes the machine to be particularly useful upon a flat, horizontal roof. Stand-up screw guns are exemplified in Murray, U.S. Pat. No.

3,960,191, Dewey, U.S. Pat. No. 4,236,555, and Dewey, U.S. Pat. No. 4,397,412. Components of a nailer or components of a stapler may be alternatively used in the machine as broadly contemplated.

The shoe, to which the fastener-driving means is mounted as mentioned, may be gravitationally biased so as to urge the shoe toward the batten while the batten is being fastened by means of the machine. The shoe may be additionally biased by spring means operatively disposed between the shoe and the base, such as, for example, a coiled spring operatively interposed between the shoe and the base, so as to bias the shoe as mentioned above. Provision of such a spring is preferred.

Preferably, the machine comprises a canister mounted upon the base and arranged to contain a batten provided in the form of a coil, from which the batten can be supplied to the shoe, the canister having an outlet through which the batten can be supplied to the shoe. If a batten made from such metallic or polymeric materials as are typically used to make battens is provided in the form of a coil as mentioned, the coil is characterized by a tendency to expand (that is, the batten tends to straighten) when released. If the machine comprises a canister as mentioned, the canister is arranged to contain a batten provided in the form of a coil and to supply the batten from the coil to the shoe, through the outlet of the canister. There is no need for such a coil, when contained within the canister, to have a core. According to one aspect of this invention, the machine comprises such a canister and is combined with such a batten coil.

Because the machine positions the batten beneath the underside of the shoe, and between the guides of the shoe, while the batten is being fastened by means of the machine, the fastener to be driven by means of the machine can be generally centered vis-a-vis the expansive surfaces of the batten, so as to minimize tendencies of the batten to split when such a fastener is driven through the batten, if the fastener is not driven through the pre-formed hole within the batten. Preferably, therefore, the shoe guides are spaced from each other by means of a distance allowing sufficient clearance for the batten, but not allowing excessive clearance.

Because the shoe and the base can have relative movement therebetween as mentioned, the shoe tends to adjust to localized irregularities upon the sheet of roofing material as the batten is positioned by means of the shoe, particularly but not exclusively if the guides of the shoe depend more deeply from the underside of the shoe than the thickness of the batten.

If the machine comprises a canister containing a batten coil as mentioned, there is no need for a worker to manually lay a series of individual battens along a sheet of roofing material or to manually deploy a batten straightened from a batten coil along such a sheet, once a first fastener has been driven through the batten and into the underlayment. A batten supplied from such a coil can be easily aligned with one edge of such a sheet or with another line of reference, by manipulation of the machine, once a first fastener has been driven through the batten and into the underlayment, as mentioned.

BRIEF DESCRIPTION OF THE DRAWINGS

These and other objects, features and advantages of this invention are evident from the following description of a preferred embodiment of this invention with reference to the accompanying drawing, in which like reference characters designate like or corresponding parts throughout the several views, and wherein:

FIG. 1 is a perspective view of a fastener-driving and batten-positioning machine constituting a preferred embodiment of this invention, wherein a polymeric batten, as provided in the form of a coil, has been loaded into a canister of the machine.

FIG. 2 is an enlarged, fragmentary, perspective view of the machine disposed upon a sheet of roofing material, wherein certain components are broken away so as to reveal other components, and a leading end of the batten is shown.

FIG. 3 is an exploded, fragmentary view of certain components removed from the machine, as shown in FIG. 2.

FIG. 4 is a plan view taken from the bottom of those components shown in FIG. 3.

FIG. 5 is an enlarged, elevational view of a tubular nosepiece, which is one of the components shown in FIG. 3, the nosepiece, as shown in FIG. 5, having been rotated from its position in FIG. 3.

FIG. 6 is a an exploded view of the tubular nosepiece, which is shown fragmentarily, and a mounting base, which is integral with a lower part of a shoe used in the machine.

FIG. 11 is a similarly enlarged, fragmentary, elevational view of the machine as taken from one end, namely the left end of the machine as shown in FIG. 7.

FIGS. 12 and 13 are fragmentary, sectional views taken respectively along line 12—12 and line 13—13 in FIG. 7, in directions indicated by means of the arrows.

FIGS. 14, 15, and 16 are views taken in top plan, side elevation, and end elevation respectively to show the lower part of the shoe used in the machine, the shoe having been removed from the machine.

FIG. 17 is a perspective view taken from the bottom and left end of the part shown in FIGS. 14, 15, and 16.

FIG. 18 is a fragmentary, cross-sectional view taken along line 18—18 of FIG. 11, in the direction indicated by means of the arrows.

DETAILED DESCRIPTION OF PREFERRED EMBODIMENT

Figure 7:
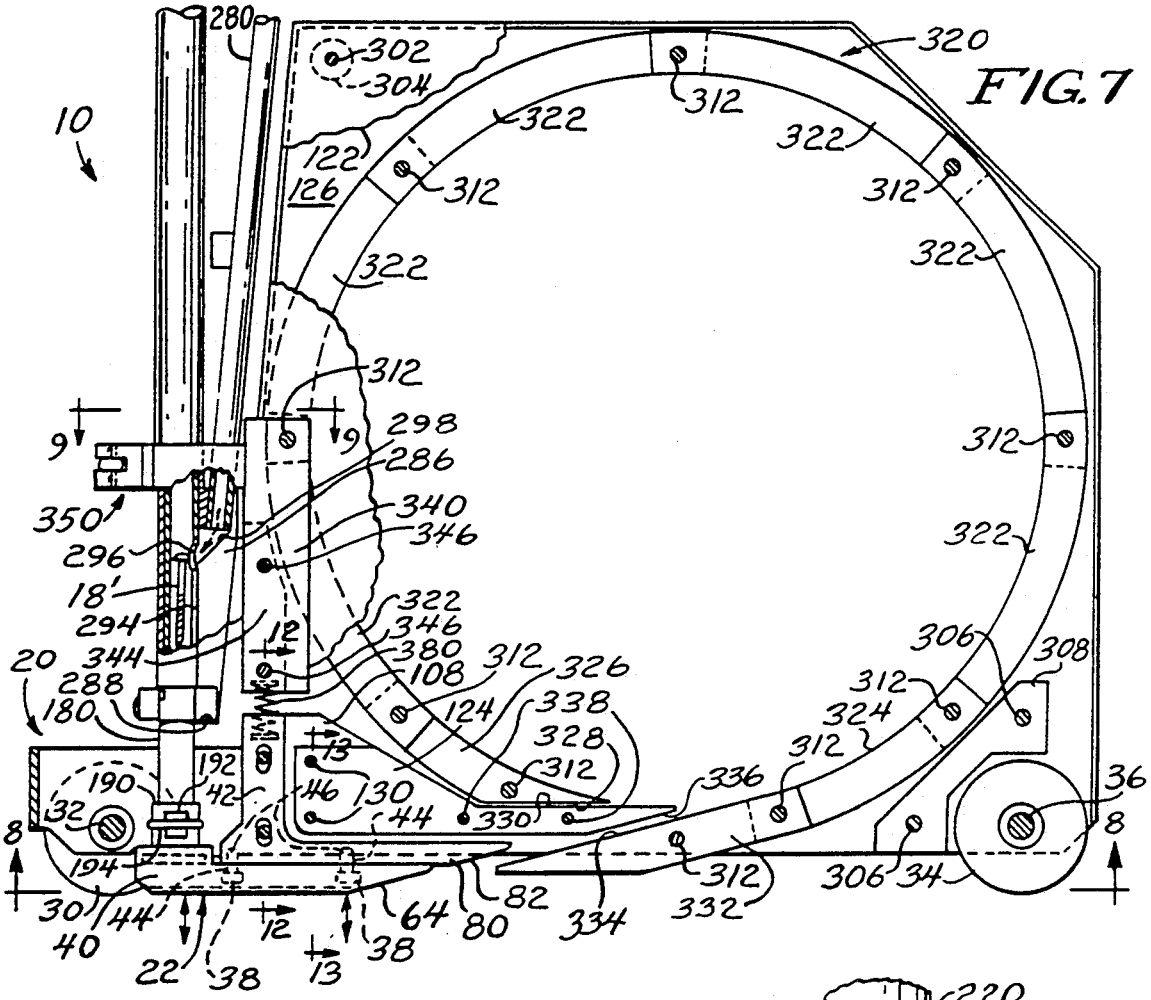
FIG. 7 is a fragmentary, elevational view of the machine, as taken from one side, namely the side from which the magazine is loaded, the batten having been omitted for the purposes of clarity.

As shown in the drawings, a fastener-driving and batten-dispensing machine 10, which constitutes a preferred embodiment of this invention, is used to dispense a batten, such as the exemplary batten 12 shown in FIGS. 1 and 2, and an underlying sheet of roofing material, such as the exemplary sheet 14 shown in FIGS. 1, 2, and 18, to an underlayment, such as, for example, the wooden underlayment 16 shown in FIG. 18, and to fasten the batten, the underlying sheet of roofing material, and any similar or different sheets (not shown) of roofing material underlying the sheet underlying the batten, to the underlayment by means of a series of screws, such as the exemplary screw 18 shown in FIG. 18.

Preferably, as exemplified by means of the batten 12, the batten is a polymeric batten, more preferably a polymeric batten as described and claimed in a co-pending United States patent application filed by Frederick A. Kish and Parimal M. Vadhar on Jan. 6, 1989, under Ser. No. 294,325, assigned commonly herewith, and entitled "CORROSION AND SPLIT RESISTANT PLASTIC MATERIALS." Moreover the batten is an elongated strip, which is provided in the form of a coil as discussed below, and which has two parallel, expansive surfaces, that is, a top surface and a bottom surface, between two parallel edges. The batten is not provided with pre-formed holes. Thus, exemplary batten 12 is an elongated strip, which is provided in the form of a coil as discussed below, and which has a top surface and a bottom surface between two parallel edges, and which is not provided with pre-formed holes. If the sheet underlying the batten is a roofing membrane as mentioned above, the batten may be advantageously fastened along one edge of such sheet, where the edge of such sheet overlaps one edge of another such sheet (not shown) which is adjacent to the sheet underlying the batten except where the edges overlap. A blanket (not shown) of roofing insulation may underlie the sheet underlying the batten where the batten is fastened. A wooden roof or a corrugated metal roof may constitute the underlayment. Conventional, pan head, self-tapping screws may be used. Screws with Phillips TM cross-slotted heads are preferred. Suitable screws are available commercially from ITW Buildex (a division of Illinois Tool Works Inc.) of Itasca, Illinois, under its ROOFGRIP trademark.

The machine 10 dispenses a batten, such as, for example, the batten 12, in a continuous length, and drives screws, such as, for example, the screw 18 shown in FIG. 18, through the batten, through the sheet or sheets underlying the batten, such as, for example, the sheet 14, and into the underlayment, at spaced locations along the batten, for example, at 6-inch or 12-inch intervals. A wand (not shown) of a suitable length, for example, six inches or twelve inches, may extend rearwardly from the machine 10, to which the wand may be suitably affixed, so as to facilitate spacing the screws at regular intervals along the batten. The wand may be suitably marked with a scale of linear measurements.

As its principal components, the machine 10 comprises a base 20, a shoe 22 mounted upon the base 20 so as to permit relative movement between the shoe 22 and the base 20, namely for vertical movement of the shoe 22 relative to the base 20, fastener-driving means 24 operatively mounted upon the base 20, and a canister 26 mounted upon the base 20 and arranged to receive a batten provided in the form of a coil. Each of the principal components of the machine 10 is discussed below.

The machine 10 is provided with a pair of rollers 30, which are disposed at a back portion of the machine, and which are journalled to the base 20, on opposite sides of the base, by means of an axle 32, so that the rollers are exposed beneath the base 20. The machine 10 is also provided with a roller 34, which is disposed at a front portion of the machine 10, and which is journalled to the canister 26, between its side walls described below, by means of an axle 36, so that the roller 34 is exposed beneath the canister 26. The rollers 30 and the roller 34 enable the machine 10 to be easily moved from location to location along a sheet of roofing material.

The shoe 22 is made in two parts, namely a lower, batten-positioning part 40 and an upper, shoe-guiding part 42, which are assembled together by means of a pair of machine (cap) screws 38 passing through countersunk apertures 44 within the lower part 40 and being threaded into threaded apertures 46 within the upper part 42 as best seen in FIG. 7.

The lower, batten-positioning part 40 has a planar underside 54, from which a pair of batten guides 56, 58, depend to uniform depths, in parallel relation with respect to each other. Preferably, when a batten, such as, for example, the batten 12 is selected for the machine 10, the batten should be slightly thinner than such depths and slightly narrower than the distance between the guides 56, 58, so as to provide sufficient clearance to permit relative movement between such part 40 and the batten, along the longitudinal edges of the batten, when the batten is disposed between the guides 56, 58, and when the guides 56, 58, bear against a sheet of roofing material underlying the batten, however, the clearance should not be excessive.

Thus, the shoe 22 positions the batten over a sheet of roofing material underlying the batten and the batten tends to be generally centered by means of the guides 56, 58. In addition, a screw being driven by means of the machine 10 in a manner to be later described tends to be generally centered between the opposite edges of the batten, so as to minimize any tendencies of the batten to split when the screw is driven through the batten. It may be recalled that a batten, such as, for example, the batten 12 does not have pre-formed holes.

The lower, batten-positioning part 40 is provided with a circular aperture 60 having a hardened, upper margin, which is indicated by reticular shading lines in FIGS. 6 and 16. The circular aperture 60 accommodates a screw and a driving bit driving the screw in a manner to be later described. Such part 40 is provided along its planar underside 54 with a longitudinal groove 62, which merges with the circular aperture 60 and extends to the back end of such part 40, and which accommodates the head of a screw driven by means of the machine 10 through a batten (see FIG. 11) when the machine 10 is moved along the batten. Such part 40 has, at its front end, a bevelled surface 64, which facilitates feeding the leading end of the batten beneath the planar underside 54 and between the guides 56, 58, and which tends to prevent such part 40 from snagging when the machine 10 is moved forwardly. Such part 40 has, at its back end, a bevelled surface 66, which tends to prevent such part 40 from snagging when the machine 10 is moved backwardly.

The upper, shoe-guiding part 42 has two slots extending transversely through such part 42, namely an upper slot 72 and a lower slot 74, as best seen in FIG. 12. Each slot has a predetermined diameter and is arranged to loosely receive a dowel so as to permit relative movement of the dowel and such part 42 within a range of relative movement limited by means of such slot. Thus, the slot 72 receives such a dowel 76 and the slot 74 receives a similar dowel 78, and the slots 72, 74, permit relative movement of the dowels 76, 78, and such part 42 within a range of relative movement defined by means of the slots 72, 74. The dowels 76, 78, are mounted to the base 20 in a manner to be described later. The slots 72, 74, are located so that the dowels 76, 78, occupy intermediate positions (see FIG. 12) within the range of relative movement defined by means of the slots 72, 74, when the lower batten-positioning part 40 and the rollers 30, 34, bear against a flat, horizontal surface. Because the shoe 22 and the base 20 can thus have relative movement, the shoe 22, which is biased gravitationally, and additionally in a manner to be described later, tends to adjust to localized irregularities along a sheet of roofing material underlying a batten being fastened by means of the machine 10, particularly localized irregularities spanned by means of the rollers 30 at the back portion of the machine 10 and the roller 34 at the front portion of the machine 10, such as, for example, localized irregularities attributable to battens extending transversely and underlying a sheet of roofing material underlying the batten being fastened by means of the machine 10.

The upper, shoe-guiding part 42 has, at its front end, an elongate tongue 80, as best seen in FIG. 7, with a bevelled surface 82, which is coplanar with the bevelled surface 64 defined upon the front end of the lower, batten-positioning part 40, and which also facilitates feeding the leading end of a batten as mentioned.

The base 20 comprises a channel 100, which includes a back wall 102 and a pair of parallel arms defining lateral walls 104, 106. The axle 32 for the rollers 30 passes through suitable apertures defined within the lateral walls 104, 106, and is provided with retainers 108, 110, at its opposite ends. The base 20, at its back end, has a sandwiched assembly of multiple components, namely the lateral wall 104, a lateral plate 120, a lateral wall 126 of the canister 26, a central spacer 124, a lateral wall 122 of the canister 26, a lateral plate 128 similar to the lateral plate 120, and the lateral plate 128 similar to the lateral plate 120, and the lateral wall 106, as assembled by means of three bolts 130, only two of which are shown in FIG. 13, each bolt 130 passing through suitable apertures defined within the sandwiched components and having a nut 132 threaded onto each bolt 130.

The lateral plate 120 has an upper, cylindrical aperture 140 and a lower, cylindrical aperture 142. The lateral plate 128 has an upper, cylindrical aperture 144 and a lower, cylindrical aperture 146. The upper apertures 140, 144, of the lateral plates 120, 128, receive the opposite ends of the dowel 76, which is retained at its opposite ends by means of the lateral walls 104, 106. The lower apertures 142, 146, of the lateral plates 120, 128, receive the opposite ends of the dowel 78, which is retained by means of the lateral walls 104, 106. The dowels 76, 78, may be loosely fitted into the respective apertures of the lateral plates 120, 128, so as to facilitate assembly.

A mounting base 160, which is an integral portion of the lower, batten-positioning part 40 of the shoe 22, has an upwardly opening recess 162, which is open at one side of the part 40 (see FIGS. 6 and 14) and closed at the other side of the part 40 by means of a curved edge 164. At its upper margin, the circular aperture 60 opens into the recess 162. The mounting base 160 has undercut grooves that form a flange 166 extending forwardly from a back wall 168 of the recess 162 and a flange 170 extending backwardly from a front wall 172 of the recess 162. Such walls 168, 172, merge with the curved edge 164. The recess 162 is symmetrical when viewed in top plan (see FIG. 14). The mounting base 160 is used to mount the fastener-driving means 24.

The fastener-driving means 24 is defined by means of standard components of a stand-up screw gun of a type which is commercially available from ITW Buildex (a division of Illinois Tool Works Inc.) of Itasca, Illinois, under its ACCUDRIVE XL trademark, and exemplified in Murray, U.S. Pat. No. 3,960,191, Dewey, U.S. Pat. No. 4,236,555, and Dewey, U.S. Pat. No. 4,397,412, the disclosures of which patents are incorporated herein by reference.

The fastener-driving means 24 comprises a tubular nosepiece 180, which is provided with a mounting plate 182 integral with the lower end of such nosepiece 180, as best seen in FIG. 6. Preferably, the nosepiece 180 and the plate 182 are made as a single part, although welded parts may be alternately used. The mounting plate 182 is rectangular except for three rounded corners (see FIG. 4) and has a circular aperture 184, which is concentric with the tubular nosepiece 180, and which is bounded at its lower margin by means of an annular boss 186. The annular boss 186 is sized to fit into the circular aperture 60 of the lower, batten-positioning part 40 of the shoe 22. The mounting plate 182 is narrower but longer than the distance defined between the distal edges of the flanges 166, 170, and has a thickness allowing opposed portions of such plate 182 to fit into the undercut grooves forming the flanges 166, 170. Thus, when the tubular nosepiece 180 is mounted to the mounting base 160, such nosepiece 180 is rotated so that the mounting plate 182 can be inserted between the distal edges of the flanges 166, 170. Also, the nosepiece 180 is centered so that the annular boss 186 fits into the circular aperture 60 when the nosepiece 180 is inserted between the distal edges of the flanges 166, 170. After the nosepiece 180 has been rotated, centered, and lowered as mentioned (see FIG. 6), the nosepiece 180 is rotated one quarter-turn in a clockwise sense looking downwardly along the nosepiece 180, as permitted by the rounded corners until the shorter, straight edge of the mounting plate 182 bears against the wall 172 associated with the flange 170, which thus limits further rotation of the nosepiece 180 in the same (clockwise) sense after the nosepiece 180 has been lowered as mentioned. Because one corner 188 of the mounting plate 182 is not rounded, the nosepiece 180 cannot be rotated in the reverse or counterclockwise direction to any significant degree of angular displacement, after the nosepiece 180 has been lowered as mentioned.

The tubular nosepiece 180 is provided at its lower end, above the mounting plate 182, with an integral collar 190 and with a pair of jaws 192, which extend radially into diametrically opposed apertures defined within the integral collar 190, and which are biased inwardly in a radial sense by means of an elastomeric O-ring 194 disposed around the integral collar 190 and removably seated within suitable grooves defined within the respective jaws 192. Similar jaws biased by means of such an 0-ring are disclosed in Dewey, U.S. Pat. No. 4,236,555. The jaws 192, which are adapted to be outwardly cammed in a manner to be described later, position a screw, such as, for example, the screw 18 in axial alignment with a driving bit to be described later, and prevent the screw from dropping through the nosepiece 180 before the screw is driven by means of the driving bit, but also permit the screw to be ejected downwardly as the screw is driven.

As shown in FIG. 3, the nosepiece 180 is provided externally with a J-shaped groove 212, which has a longer, vertical portion 214 leading to the upper end of the nosepiece 180, a curved, transitional portion 216, and a shorter, vertical portion 218. The curved, transitional portion 216 leads to the lower end of the longer, vertical portion 214 and to a midsection of the shorter, vertical portion 218.

As shown in FIGS. 1, 2, and 3, a tubular element 220 is telescoped over the tubular nosepiece 180. A horseshoe-shaped bracket 222, which partly surrounds the tubular element 220, is welded to the tubular element 220. The bracket 222 receives a machine screw 224 having a threaded shank, which passes trough an aperture defined within the bracket 222, and through an axially aligned, threaded aperture defined within a lower end portion of the tubular element 220, and which extends with an unthreaded extremity into the groove 212 when the tubular element 220 is telescoped over the tubular nosepiece 180. When the tubular element 220 and the tubular nosepiece 180 are assembled, the threaded shank of the machine screw 224 is manipulated down the longer vertical portion 214, through the curved transitional portion 216, and into the shorter vertical portion 218, which allows a limited range of vertical movement of the tubular element 220 relative to the tubular nosepiece 180, and which prevents the tubular nosepiece 180 from rotating within the mounting base 160.

A coiled spring 226 is disposed within the tubular element 220 so as to bear at its lower end, by means of an annular washer 228 fixed to the lower end of the coiled spring 226, against the upper end of the tubular nosepiece 180, and to bear at its upper end against an annular stop (not shown) disposed within the tubular element 220, and thereby bias the tubular element 220 upwardly through the limited range of vertical movement of the tubular element 220 relative to the tubular nosepiece 180. The threaded shank of the machine screw 224 engages the annular washer 228 at the lower end of the coil spring 226 so as to prevent the same from being ejected from the tubular element 220 when the tubular element 220 and the tubular nosepiece 180 are disassembled.

As shown in FIG. 1, a tubular element 230 is telescoped over the tubular element 220. The tubular element 230 is provided with a wide vertical slot 232. A fitment 234, which is attached to an upper end portion of the tubular element 220 which is telescoped within the lower portion of the tubular element 230, extends outwardly through the slot 232, which provides a limited range of vertical movement of the tubular element 230 relative to the tubular element 220.

A coiled spring 236 is disposed within the tubular element 230 so as to bear at its lower end against the tubular element 220, and to bear at its upper end against an annular stop (not shown) which is mounted within the tubular element 230 by machine screws (not shown) mounted within threaded apertures within the tubular element 230, and thereby bias the tubular element 230 upwardly within the limited range of vertical movement of the tubular element 30 relative to the tubular element 220.

A trigger-actuatable, electrically powered screw gun 60 is mounted in a known manner to the upper end of the tubular element 230. The screw gun 260 comprises an elongate, rod-like driver 262 carrying a driving bit 264, which is removably attached to the driver 262 (see FIG. 18) at its lower end. The driving bit 264, as shown, is a Phillips TM cross-shaped bit, which is adapted to drive a screw having a Phillips TM cross-slotted head, such as, for example, the screw 18 shown in FIG. 18, when the screw gun 260 is actuated with the driving bit 264 engaged with the head of the screw. The driving bit 264 can be so engaged only when the tubular element 230 has been forcibly moved downwardly along the tubular element 220 and the tubular element 220 has been forcibly moved downwardly along the tubular nosepiece 180. The driving bit 264 is adapted to cam the jaws 192 outwardly when moved downwardly with the tubular elements 220, 230. The coiled springs 226, 236, are selected to have spring characteristics enabling the tubular element 220 to be so moved only after the tubular element 230 has been so moved so as to cause the coiled spring 226 to be fully compressed, or nearly so.

Figure 10:
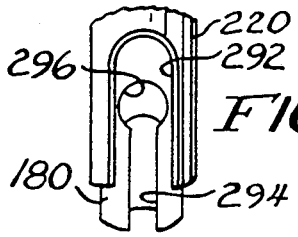
FIG. 10 is a similarly enlarged, fragmentary detail of certain components removed from the machine as shown in FIG. 7 but rotated from their positions in FIG. 7.

A screw-feeding tube 280 is removably mounted upon the tubular element 220. A fitment 282, which is welded to the tube 280, is arranged to be removably connected, by means of a bolt receiving a wing nut 284, to the fitment 234, which as mentioned is attached to an upper end portion of the tubular element 220. A screw-deflecting slide 286, as best seen in FIGS. 2 and 7, which is rigidly mounted to the lower end of the tube 280, has a pair of ears 288 (one shown) formed within distal ends of the horseshoe-shaped bracket 222 (see FIG. 2) when the fitment 282 is connected to the fitment 234, so as to mount the tube 280 upon the tubular element 220. Where the tubular element 220 confronts the slide 286, the tubular element 220 is provided with a wide, vertical slot 292 (see FIG. 10) providing sufficient clearance for a screw fed through the tube 280. Where the vertical slot 292 confronts the tubular nosepiece 180 when the tubular element is in its uppermost position relative to the tubular nosepiece 180, the tubular nosepiece 180 is provided with a narrow, vertical slot 294 having an enlarged upper end 296 and providing sufficient clearance for a screw fed through the tube 280 when the tubular element 220 is in such position, so long as the head of the screw is upward as the screw is fed through the tube 280. The enlarged upper end 296 of the slot 294 provides sufficient clearance for the head of the screw (see, for example, the screw 18' shown in FIG. 7) whereas the remaining portions of the slot 294 provide sufficient clearance only for the threaded shank of the screw. The slide 286 has internal formations (see FIG. 7) which deflect the head of the screw through the slot 292 into the enlarged upper end 296 of the slot 294. When the tubular element 220 is not in its uppermost position relative to the tubular nosepiece 180, the vertical slot 292 does not confront the vertical slot 294, and a screw within the vertical slot 292 cannot enter the vertical slot 294.

As described so far, except for the described connection of the tubular nosepiece 180 to the lower recess 162 of the mounting base 160, and except for other features described herein, the tubular nosepiece 180, the tubular element 220, the tubular element 230, the screw gun 260, the feed tube 280, and associated components described above are similar to similarly functioning components of stand-up screw guns sold heretofore by ITW-Buildex (Illinois Tool Works Inc.), Itasca, Ill., under its ACCUDRIVE XL trademark. Since such components and their functions are known to those skilled in the art, further description of these and other components of the stand-up screw gun comprising the fastener driving means 24 and their functions is not necessary, except as given herein.

The lateral wall 122 of the canister 26 has a large D-shaped aperture 300, which is sized to admit a batten, such as, for example, the batten 12, in the form of a coil C, preferably in a relatively tight coil, which tends to expand to a relatively loose coil when released within the canister 26. The lateral walls 122, 126, of the canister 26 have peripheral flanges (see FIG. 1) which abut each other along exposed front, upper, and back (but not lower) edges of the canister 26. Such walls 122, 126, are assembled not only by means of the bolts 130 mentioned above which pass through the central spacer 124 but also by means of a bolt 302 passing through the wall 122, an annular spacer 304, and the wall 122, at an upper, back corner of the canister 26, a pair of bolts 306 passing through the wall 122, a polygonal spacer 308, and the wall 126, at a lower, front corner of the canister 26, as best seen in FIG. 7, and by means of a series of bolts 312, each of the bolts 312 passing through the wall 122, various components defining and extending from a circumferential hoop 320, and the wall 126. Such components are joined to one another with lapped ends, through which the bolts 312 pass, and include six arcuate segments 322 which are equal in arcuate length, one arcuate segment 324, which is shorter than the six segments 322 in arcuate length, a truncated segment 326, which is arcuate but which is truncated so as to have a bevelled surface 328 adjacent to a facing surface 330 of the central spacer 124, and a lower tongue 332, which has a guiding surface 334 facing a bevelled surface 336 of the central spacer 124 so as to define an outlet (for a batten, such as, for example, the batten 12) between such surfaces 334, 336, and between the lateral walls 122, 126, of the canister 26. A batten being fed through the outlet is directed along the bevelled surface 82 of the elongated tongue 80 integral with the upper, shoe-guiding part 42 of the shoe 22, and between the batten guides 56, 58, of the lower, batten-positioning part 40 of the shoe 22. Two bolts 338, which pass through the wall 122, the central spacer 124, and the wall 126, are also used to assemble the walls 122, 126, and the central spacer 124.

Figure 9:
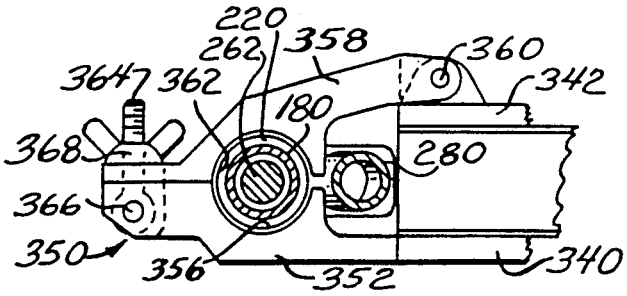
FIG. 9 is a further enlarged, fragmentary detail of a clamp used to clamp a screw gun to other components of the machine, FIG. 9 showing the top of the clamp, which is shown in side elevation in FIG. 7.

One bolt 312 mounts a mounting plate 340 exteriorly of the lateral wall 122 of the canister and mounts a mounting plate 342 outside of the lateral wall 124. A central spacer 344 is mounted between the mounting plates 340, 342, by means of a pair of bolts 346 assembling the mounting plate 340, the wall 122, the central spacer 344, the wall 126, and the mounting plate 342. A clamp 350, as seen in FIG. 9, which is used to clamp the stand-up screw gun 260, comprises a fixed part 352, which is welded to the mounting plate 340 and which has a semicircular cavity 356 defined therein so as to loosely receive the tubular element 220, and a hinged part 358, which is hinged to the mounting plate 342 by means of a hinge pin 360 and which has a semicircular cavity 362 defined therein so as to loosely receive the tubular element 220. The clamp 350 also comprises a bolt 364, which is pivotally mounted upon the fixed part 352 by means of a pivot pin 366, within a bifurcated portion of the fixed part 52, for pivotal movement into a bifurcated portion of the hinged part 358 when the clamp 350 is closed around the tubular element 220 (see FIG. 9) and for pivotal movement outwardly from the bifurcated portion of the hinged part 358 when the clamp 350 is opened. The clamp 350 further comprises a wing nut 368, which is threadable onto the bolt 64 so as to releasably lock the clamp 350 in its closed condition. The fixed and hinged parts 352, 358, of the clamp 350 are configured, as shown in FIG. 9, so as to clear the screw-feeding tube 280 when the clamp 350 is clamped around the tubular element 220. When the clamp 350 is closed around the tubular element 220, relative movement is permitted between the tubular element 220 and the clamp 50, which loosely clamps the tubular element 220.

A coiled spring 380 is operatively disposed between the central spacer 344 and the upper, shoe-guiding part 42 of the shoe 22, so as to bias the shoe 22 downwardly, as best seen in FIG. 12. The central spacer 344 has a lower socket 382, which receives the upper end of the coiled spring 380. The part 42 has an upper socket 384, which receives the lower end of the coiled spring 380.

The various segments of the circumferential hoop 320 are made from an engineering polymer having a lubricous quality when rubbed by means of a batten being pulled from the canister 26, such as, for example, Delrinr TM acetal homopolymer available commercially from E.I. DuPont de Nemours & Co. of Wilmington, Delaware. The spacers 304, 308, and the rollers 30, 34 may also be made from the same polymer. Other batten-contracting components of the machine 10 may be advantageously made of steel, such as, for example, electroless nickel-plated steel. The canister walls 122, 126, may be advantageously made of painted steel.

A batten such as the batten 12 can be easily loaded into the canister 26, by means of the D-shaped aperture 300 defined within lateral wall 122, in a relatively tight coil, and which can then be released so as to allow the coil to expand to a relatively loose coil within the canister 26, as shown in FIG. 1. The batten is confined, as a relatively loose coil, by means of the circumferential hoop 320, so that (when the machine 10 has been positioned where the batten is to be located for fastening) the leading end of the batten can be manually fed through the outlet defined by means of the surfaces 334, 336, and by the lateral walls 122, 126, until the leading end of the batten is disposed beneath the planar underside 54 of the lower, batten-positioning part 40 of the shoe 22, and between the batten guides 56, 58.

Figure 8:
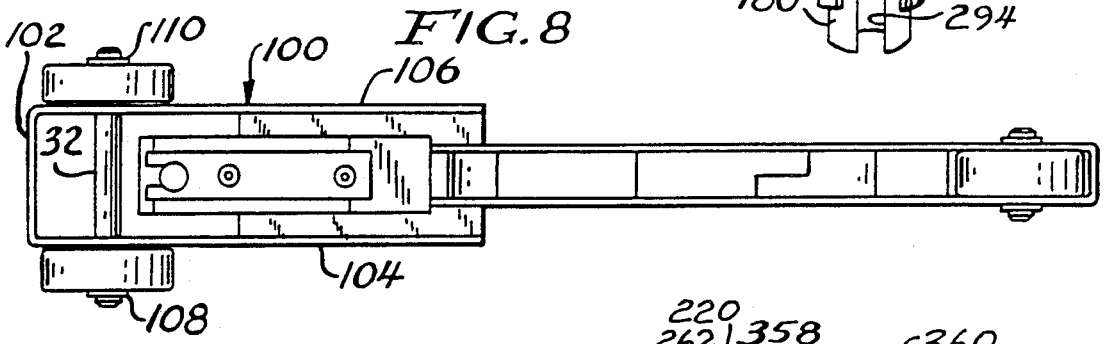
FIG. 8 is a plan view taken from the bottom of the machine as is shown in FIG. 7.

The machine 10 is manually positioned upon a sheet of roofing material, such as, for example, the sheet 14, where the batten and the sheet of roofing material underlying the batten, along with any sheets of roofing material underlying such sheet, can then be fastened to an underlayment by means of a series of screws, such as, for example, the screw 18 shown in FIG. 18. Each screw is dropped (head upward) into the screw-feeding tube 280, whereupon such screw is caught by means of the jaws 192. After a screw has been caught by means of the jaws 192, the screw gun 260 is manually pushed downwardly, so as to cause the tubular element 230 to telescope over tubular element 220 and the tubular element 220 to telescope over the tubular nosepiece 180, until the driving bit 264 engages the head of the screw. Upon actuation of the screw gun 260 and the application of manual pressure upon the screw gun 260 in a downward direction, the screw may then be driven through the batten and the underlying sheet or sheets of roofing material, into the underlayment. After at least one screw has been driven into the underlayment, the machine 10 may then be moved forwardly so as to deploy the batten, which as fastened by means of the screw or screws is pulled from the canister 26 and uncoils itself as the machine 10 is moved forwardly, until the machine 10 reaches another location where another screw is similarly to be driven, the process being repeated as desired. Because the machine 10 has a narrow profile (see, for example, FIG. 8) the machine 10 is useful to fasten a batten along and in close proximity to a vertical wall (not shown).

Strap-cutting shears or similar means (not shown) are useful to sever the batten ahead of a vertical wall (not shown) or other obstacle whereupon it may then be desired to apply one or more screws by means of a hand-held screw gun (not shown) or other similar means, along the trailing end of the batten, where the machine 10 cannot fit. Alternatively, the machine 10 can be lifted, rotated one half turn about a vertical axis, and repositioned over the trailing end of the batten, so as to then be useful to fasten the trailing end of the batten.

Various modifications may be made in the structure of the machine 10 without departing from the scope and spirit of this invention as defined by means of the appended claims.

We claim:

1. A fastener-driving and batten-positioning machine useful for positioning an elongate batten upon a support surface, and for fastening the positioned batten to said support surface by means of a plurality of fasteners at spaced locations along said elongate batten, comprising:

a support base;

a shoe mounted upon said support base and having an undersurface and laterally spaced guides depending downwardly from said undersurface at laterally spaced side portions of said shoe so as to define with said undersurface an open-ended, downwardly open, elongate channel for longitudinally guiding and laterally confining said batten in position above said support surface to which said batten is to be fastened by said plurality of fasteners; and fastener-driving means mounted upon said shoe for driving said fasteners through said batten positioned by said shoe and into said support surface at predetermined locations along said batten.

2. A machine as set forth in claim 1, further comprising:

means for movably mounting said shoe upon said support base such that said shoe is biased toward said batten while said batten is being fastened to said support surface by said machine.

3. The machine of claim 2, wherein:

said means movably mounting said shoe upon said support base comprises means for permitting vertical movement of said shoe upon said support base within a predetermined range so as to permit said shoe to be moved toward said batten while said batten is being fastened by said machine.

4. The machine of claim 3, additionally comprising:

spring means operatively interposed between said shoe and said base so as to bias said shoe toward said batten while said batten is being fastened by said machine.

5. The machine of claim 1, further comprising:

(d) a canister mounted to the base and arranged to contain such a batten provided in a coil, from which the batten can be then supplied to the shoe, the canister having an outlet for such a batten being supplied to the shoe.

6. The machine of claim 5, further comprising:

means movably mounting said shoe upon said support base for permitting vertical movement of said shoe with respect to said support base within a predetermined range so as to permit said shoe to be moved toward said batten while said batten is being fastened by said machine.

7. The machine of claim 6, additionally comprising:

spring means operatively interposed between said shoe and said base so as to bias said shoe toward said batten while said batten is being fastened by said machine.

8. The machine of claim 5, wherein:

said canister comprises means for containing and peripherally confining said batten in the form of a coil having a tendency to radially expand when released, and for supplying said batten from said coil to said shoe, through said outlet of said canister, whereby there is no need for said coil to have a core.

9. A machine as set forth in claim 8, further comprising:

means for movably mounting said shoe upon said support base such that said shoe is biased toward said batten while said batten is being fastened to said support surface by said machine.

10. The machine of claim 9, wherein:

said means movably mounting said shoe upon said support base comprises means for permitting vertical movement of said shoe upon said support base within a predetermined range so as to permit said shoe to be moved toward said batten while said batten is being fastened by said machine.

11. The machine of claim 10, additionally comprising:

spring means operatively interposed between said shoe and said base so as to bias said shoe toward said batten while said batten is being fastened by said machine.

12. The machine of claim 5, wherein:

said batten has a width allowing said batten to be disposed between said depending guides of said shoe, said batten being in the form of a coil having a tendency to radially expand when released, said canister comprising means for containing and peripherally confining said coil, and for supplying said batten from said coil to said shoe, through said outlet of said canister, whereby there is no need for said coil to have a core.

13. The machine of claim 5, wherein:

said guides of said shoe depend from said undersurface of said shoe for a predetermined depth; and wherein said batten has a width allowing said batten to be disposed between said guides of said shoe, and a thickness which is less than said predetermined depth, said batten being in the form of a coil having a tendency to radially expand when released, said canister comprising means for containing and peripherally confining said coil and for supplying said batten from said coil to said shoe, through said outlet of said canister, whereby there is no need for said coil to have a core.

14. A fastener-driving and batten-positioning machine useful for positioning an elongate batten upon a support surface, and for fastening the positioned batten to said support surface by means of a plurality of fasteners at spaced locations along said elongate batten, comprising:

a support base;

a shoe mounted upon said support base for positioning said batten above said support surface to which said batten is to be fastened by said plurality of fasteners;

canister means mounted upon said support base for housing said batten and including an annular hoop, for peripherally confining said batten which is in the form of a radially expansible coil, and an outlet for directing one end of said coiled batten toward said shoe; and fastener-driving means mounted upon said shoe for driving said fasteners through said batten, delivered to said shoe from said canister and positioned by said shoe with respect to said support surface, and into said support surface at predetermined locations along said batten.

15. A machine as set forth in claim 1, further comprising:

means for movably mounting said shoe upon said support base such that said shoe is biased towards said batten while said batten is being fastened to said support surface by said machine.

16. A machine as set forth in claim 14, wherein:

said shoe has an undersurface, and laterally spaced guides depending downwardly from said undersurface at laterally spaced side portions of said shoe so as to define with said undersurface an open-ended, downwardly open, elongate channel for longitudinally guiding and laterally confining said batten in position above said support surface to which said batten is to be fastened by said plurality of fasteners.

17. The machine of claim 16, wherein:

said batten has a width allowing said batten to be disposed between said depending guides of said shoe, said batten being in the from of a coil without a core, said coil having a tendency to radially expand when released, said canister comprising means for containing and peripherally confining said coil, and for supplying said batten from said coil to said shoe, through said outlet of said canister.

18. The machine of claim 16, wherein:

said depending guides of said shoe depend from said undersurface of said shoe for a predetermined depth, and wherein said batten has a width allowing said batten to be disposed between said guides of said shoe, and a thickness which is less than said predetermined depth, said batten being in the form of a coil without a core, and having a tendency to radially expand when released, said canister comprising means for containing and peripherally confining said coil, and for supplying said batten from said coil to said shoe, through said outlet of said canister.

* * * * *